US008479432B2

(12) United States Patent
Braun

(10) Patent No.: US 8,479,432 B2
(45) Date of Patent: Jul. 9, 2013

(54) NON-LETHAL WEAPON MOUNT SYSTEM WITH MODULAR WEAPON COMPONENTS

(76) Inventor: Joel L. Braun, Princeton, WI (US)

( * ) Notice: Subject to any disclaimer, the term of this patent is extended or adjusted under 35 U.S.C. 154(b) by 0 days.

(21) Appl. No.: 13/206,444

(22) Filed: Aug. 9, 2011

(65) Prior Publication Data

US 2012/0036990 A1 Feb. 16, 2012

Related U.S. Application Data

(60) Provisional application No. 61/372,278, filed on Aug. 10, 2010.

(51) Int. Cl.
*F41C 27/00* (2006.01)

(52) U.S. Cl.
USPC ..... 42/106; 42/71.01; 42/1.11; 42/1.08; 89/37.01; 222/79; 362/110; 362/113; 362/114

(58) Field of Classification Search
USPC . 89/37.01; 42/1.11, 1.08, 106, 71.01; 222/79; 362/110, 113, 114
See application file for complete search history.

(56) References Cited

U.S. PATENT DOCUMENTS

| | | | | |
|---|---|---|---|---|
| 3,793,759 | A * | 2/1974 | Deckard | 42/1.11 |
| 4,398,365 | A * | 8/1983 | Pokhis | 42/1.11 |
| 5,549,220 | A | 8/1996 | Whalen | |
| 5,852,253 | A * | 12/1998 | Baricos et al. | 89/1.41 |
| 6,499,855 | B1 | 12/2002 | Kukuk | |
| 6,676,270 | B2 | 1/2004 | Kostal et al. | |
| 7,152,990 | B2 | 12/2006 | Kukuk | |
| 7,524,076 | B2 | 4/2009 | Kukuk | |
| 2011/0265364 | A1 * | 11/2011 | Hayden | 42/1.11 |

OTHER PUBLICATIONS

U.S. Appl. No. 12/027,445, filed Aug. 13, 2009, Abatemarco, Michael.

* cited by examiner

*Primary Examiner* — J. Woodrow Eldred

(57) ABSTRACT

The present invention is a non-lethal weapon mount system with modular weapons components comprising at least two personal protection components capable of independent activation, and a means to increase or decrease the intensity level of at least one of the personal protection components.

20 Claims, 7 Drawing Sheets

NON-LETHAL WEAPON MOUNT SYSTEM WITH MODULAR WEAPON COMPONENTS

CROSS-REFERENCE TO RELATED APPLICATION

This application claims priority to U.S. Provisional Application No. 61/372,278 filed Aug. 10, 2010.

FIELD OF INVENTION

The present invention relates to the field of non-lethal weapons, and specifically to a non-lethal weapon mount system incorporating a plurality of modular weapons into a single structure.

GLOSSARY

Figure 1:
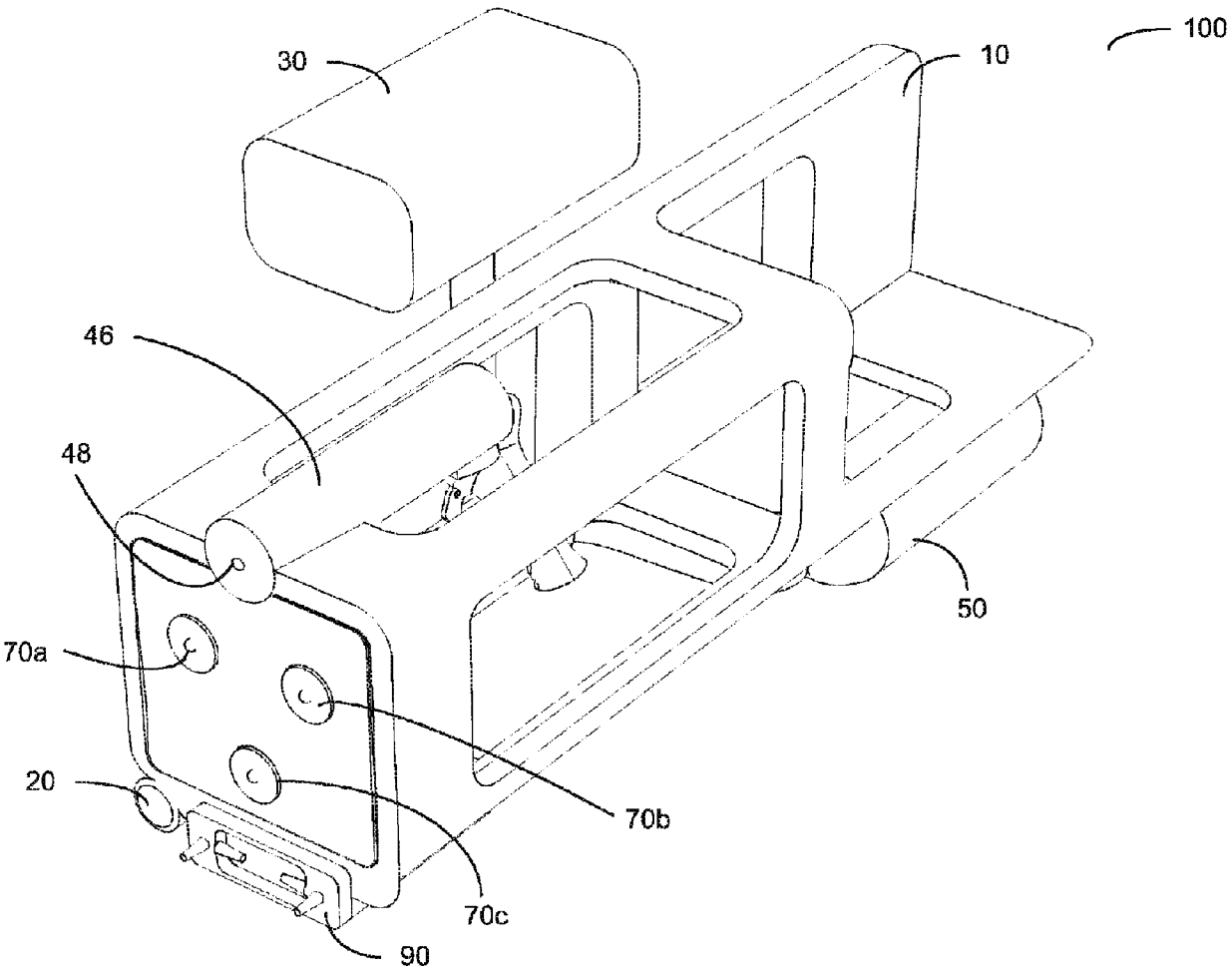
FIG. 1 illustrates a perspective view of an exemplary embodiment of an arm enclosure mount for a non-lethal weapon mount system with modular weapons components that is not mounted on an arm.

As used herein, the term "barrel" means a tubular shaft that guides the exit and discharge of non-lethal projectiles.

As used herein, the term "confirmation switch" refers to a switch that enables a master power switch to deactivate all of the modular weapons components to prevent accidental deactivation of modular weapon components.

As used herein, the term "deterrent spray" refers to any non-lethal sprayable substance that causes irritation to humans or other animals. Deterrent spray may include, but is not limited to, pepper gel, MACE, pepper spray, tear gas, and other liquid and gas irritants.

As used herein the term "frontward light panel" refers to a surface area located towards the front of a device that can accommodate structures that exude light.

As used herein, the term "hand grip" refers to a grasping component adapted to support a frame.

As used herein, the term "independently activated" refers to a weapon component than may be activated without contemporaneous activation of any other weapon component.

As used herein, the term "intensity level" refers to the output amount of a modular weapon component. Intensity levels may be varied incrementally or gradually. For example, the brightness of light emitting diodes (LEDs) may be increased or decreased by a certain number of lumens with each increase or decrease, or brightened or dimmed along a sliding scale, such as with a dimmer switch.

As used herein, the term "master power switch" refers to a switch that can deactivate all of the modular weapons components when used in conjunction with a confirmation switch.

As used herein, the term "modular weapon component" refers to a selectively attachable weapon component that may be permanently or temporarily secured onto a frame.

As used herein, the term "outward portion of the arm" refers to the end portion of the arm upon which a weapon mount structure can be secured.

As used herein, the term "non-lethal projectile launching weapon" refers to any device which launches, shoots or otherwise expels any form of projectile intended to non-lethally inhibit and incapacitate a living target. Non-lethal projectiles include, but are not limited to paint balls, pepper balls, rubber bullets, wax bullets, plastic bullets, beanbag rounds, and projectiles with electroshock effect.

As used herein, the term "Structural Surface Attachment Components" or (SSACs), refers to a surface, frame potion, rod, appendage, groove, contour, protuberance, channel, interlocking component, fastener, bolt screw, adhesive, clam bracket, track, cord strap or other equivalent which modifies the integrally constructed arm mount enclosure frame.

As used herein, the term "stunning device" refers to any non-lethal electroshock device, with or without a projectile, used to subdue a person by disrupting muscle function.

As used herein, the term "weapon component" means any individual device available for self defense that may include but is not limited to deterrent sprays, pepper sprays, non-lethal projectiles, flashlights, spotlights, flashing lights, alert lights, audible alarms, TASERs, stunning devices, stun sprays, clubs, alarms and sharp or electrified protrusions.

As used herein, the time "wireless communication device" means any wireless device that can be used for communication purpose.

BACKGROUND

Private individuals and service members, such as police officers, who face potential attackers daily, rely on non-lethal weapons to incapacitate an assailant. Such weapons include alarms, alert lights, pepper or other deterrent sprays and even stunning device type weapons. While service members such as police officers frequently carry batons, deterrent sprays, stun guns, TASERs, and non-lethal projectile firing devices, they are not currently able to operate these non-lethal weapons individually with a single device.

For example, an individual wanting an alarm, deterrent spray and a stunning device must buy, and carry, three separate devices. When faced with assailant, an individual must fumble for the proper device, and, should an initial alarm or deterrent spray not be effective, the individual must release one of the devices in order to grab and operate the stunning device. As a result, an individual being attacked must be exposed and defenseless for the period of time when transitioning to a new deterrent device.

Similarly, a police officer, faced with an assailant in the dark, will likely have one hand holding a flashlight, while the other operates a chosen defense item. Should the situation escalate, however, the office must choose between dropping the flashlight or defense weapon to reach for his or her gun.

Other devices are known in the art that combine non-lethal protection devices, but these, too, have flaws. For example, it is known in the art to combine deterrent sprays or stunning devices with flashlights, but these devices do not offer the array of personal defense means currently available individually. Further, multifunction police tools that incorporate additional non-lethal defense devices often have a single control or switch with multiple positions to activate all incorporated devices. A single control or switch with multiple positions may result in accidental activation of an unwanted component. Other devices only allow sequenced activation of components, in which case the desired function (e.g., stunning device) may first be activated after turning on other components (e.g., flashlight, alarm). As a result, an individual may need more time to respond to a fast assailant.

Existing non-lethal defense devices generally contain a single intensity. Some stunning devices and TASERs may allow limited adjustment of the amount of voltage, but flashlights, alarms, alert lights, and deterrent sprays only activate at a single intensity.

It is desirable to have nonlethal weapons available for use with a single weapon mount structure.

It is desirable to have a single weapon mount structure incorporating many modular weapon components with individual controls and activation switches for each component.

It is desirable to have a single weapon mount structure incorporating many modular weapon components with adjustable intensity levels for each component.

SUMMARY OF THE INVENTION

The present invention is a non-lethal weapon mount system with modular weapons components comprising multiple modular weapon components with individual activation switches and means for adjusting the intensity level of at least one component. The device provides multiple levels of protection which may be actuated by integrated or separately constructed mechanical triggering devices.

DETAILED DESCRIPTION OF INVENTION

For the purpose of promoting an understanding of the present invention, references are made in the text to exemplary embodiments of a non-lethal weapon mount system with modular weapons components, only some of which are described herein. It should be understood that no limitations on the scope of the invention are intended by describing these exemplary embodiments. One of ordinary skill in the art will readily appreciate that alternate but functionally equivalent materials may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 is a perspective view of an exemplary embodiment of an arm enclosure mount 100 for a non-lethal weapon mount system with modular weapons components. Arm enclosure mount 100 is composed of deterrent spray aperture 5*a*, left side aperture 5*b*, bottom aperture 5*c*, right side aperture 5*d*, arm support platform 7, and arm support appendage 8.

Marker barrel 20 and stunning device 90 are attached to the bottom of arm enclosure mount 100. Deterrent spray housing 46 is attached to the top of arm enclosure mount 100 through deterrent spray aperture 5*a*, and it holds a volume of deterrent spray. Deterrent spray housing 46 is attached to arm enclosure mount 100 by deterrent spray support contour 47, which is a structural surface attachment component (SSAC). Deterrent spray is discharged through deterrent spray nozzle 48.

LEDs 71*a*, 71*b* and 71*c* are centrally located within the front of arm enclosure mount 100. Ball hopper 30 is attached to arm enclosure mount 100 by ball hopper mount 35 (not shown in FIG. 1). Air tank 50 mounts to the bottom of arm enclosure mount 100 and connects to ball chamber 25 (not shown in FIG. 1) at air intake 55 (not shown in FIG. 1). Arm enclosure mount 100 includes air tank compartment 52, which is an SSAC.

Figure 2:
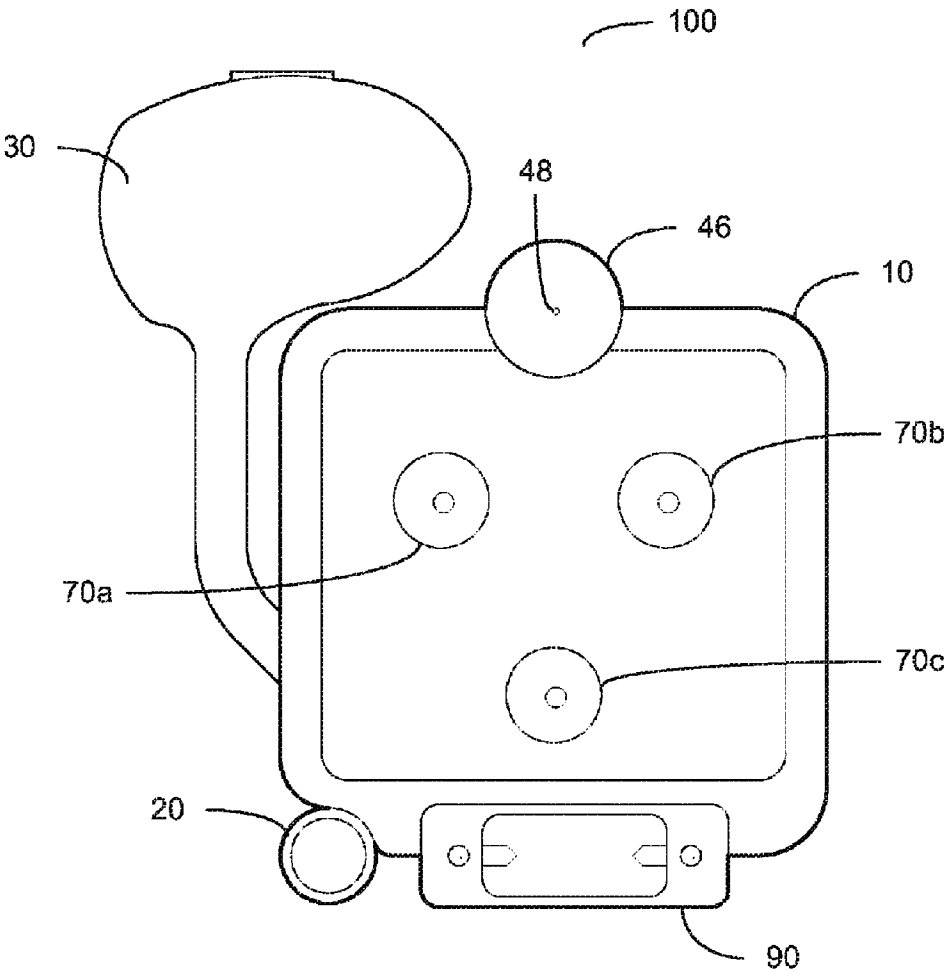
FIG. 2 illustrates a front view of an exemplary embodiment of an arm enclosure mount for a non-lethal weapon mount system with modular weapons components.

FIG. 2 is a front view of an exemplary embodiment of an arm enclosure mount 100 for a non-lethal weapon mount system with modular weapons components. Arm enclosure mount 100 is a single unit which may be made from aluminum. Marker barrel 20 and stunning device 90 are attached to the bottom of arm enclosure mount 100. Deterrent spray housing 46 is attached to the top of arm enclosure mount 100 and holds a volume of deterrent spray. Deterrent spray is discharged through deterrent spray nozzle 48. LEDs 71*a*, 71*b* and 71*c* are centrally located in the recesses of frontward light panel 70 in the front of arm enclosure mount 100.

Figure 3:
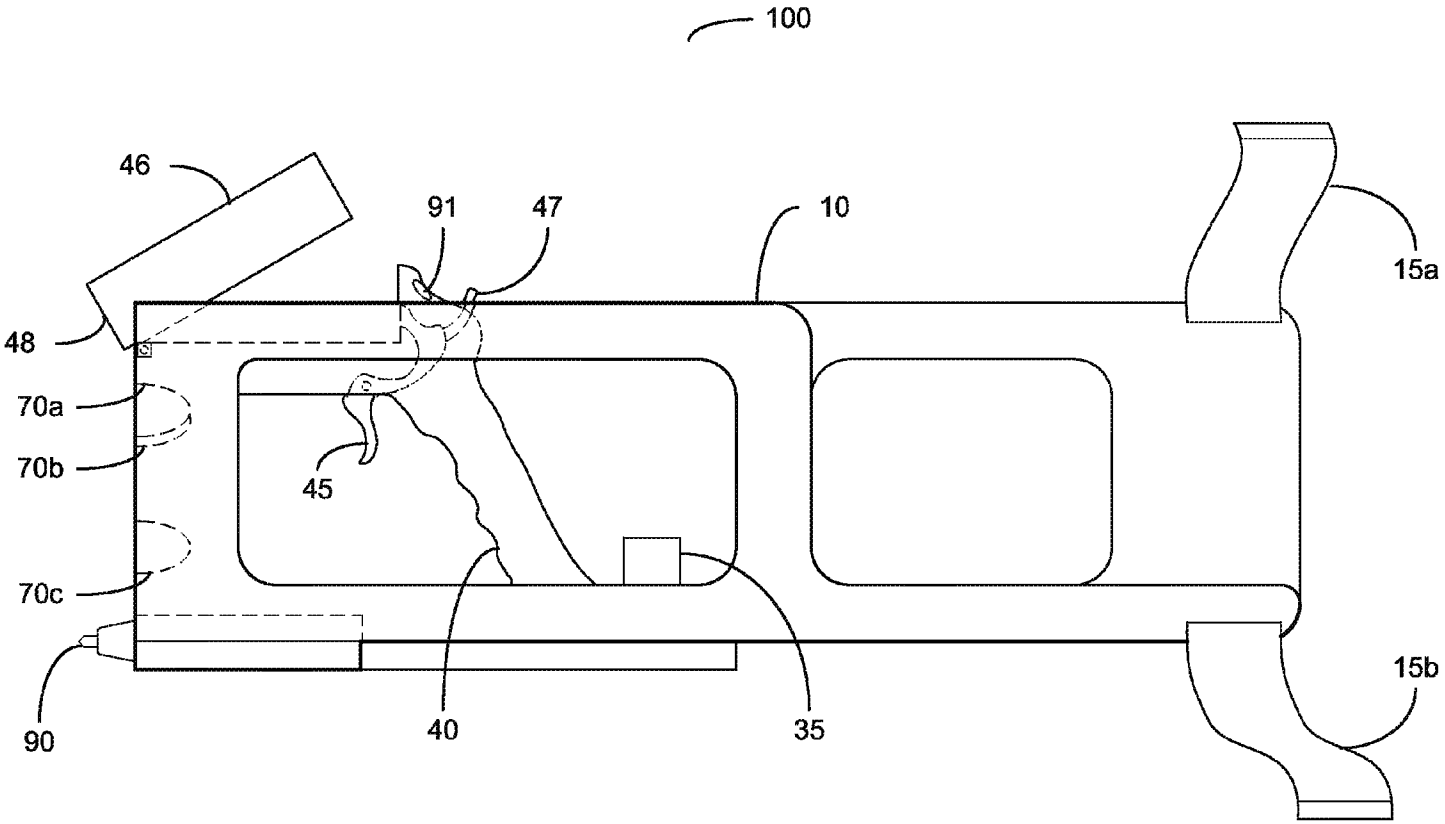
FIG. 3 illustrates a left side profile view of an exemplary embodiment of an arm enclosure mount for a non-lethal weapon mount system with modular weapons components.

FIG. 3 is a left side profile view of an exemplary embodiment of an arm enclosure mount 100 for a non-lethal weapon mount system with modular weapons components. Stunning device 90 protrudes from the lower end of the front of arm enclosure mount 100 underneath light panel 70. Arm enclosure mount 100 includes stunning device compartment 95 for stunning device 90. Stunning device compartment 95 is an SSAC.

Stunning device 90 is independently activated and deactivated by stunning device switch 91 located on hand grip 40. Stunning device switch 91 can appear on any side of hand grip 40. Because stunning device switch 91 is independently activated, a user can operate stunning device 90 independently of other non-lethal weapons when that is the appropriate non-lethal weapon to use.

Deterrent spray housing 46 pivots to allow deterrent spray to be loaded into deterrent spray housing 46. Deterrent spray housing 46 is shown in its open position to load deterrent spray. Deterrent spray is discharged through deterrent spray nozzle 48 when deterrent spray trigger 45 is squeezed. Deterrent spray trigger 45 is independently activated from other switches and triggers, allowing the user to operate the deterrent spray independently of other non-lethal weapons when that is the appropriate non-lethal weapon to use. Deterrent spray trigger 45, like all triggers for the modular weapons supported by arm enclosure mount 100, can appear on any side of hand grip 40. Deterrent spray safety switch 47 prevents accidental discharge of deterrent spray.

FIG. 3 is shown without ball hopper 30, which attaches to ball hopper mount 35.

Frame straps 15*a* and 15*b* secures arm enclosure mount 100 to a forearm. Frame strap 15*a* attaches to arm support appendage 8, and frame strap 15*b* attaches to arm support platform 7.

Figure 4:
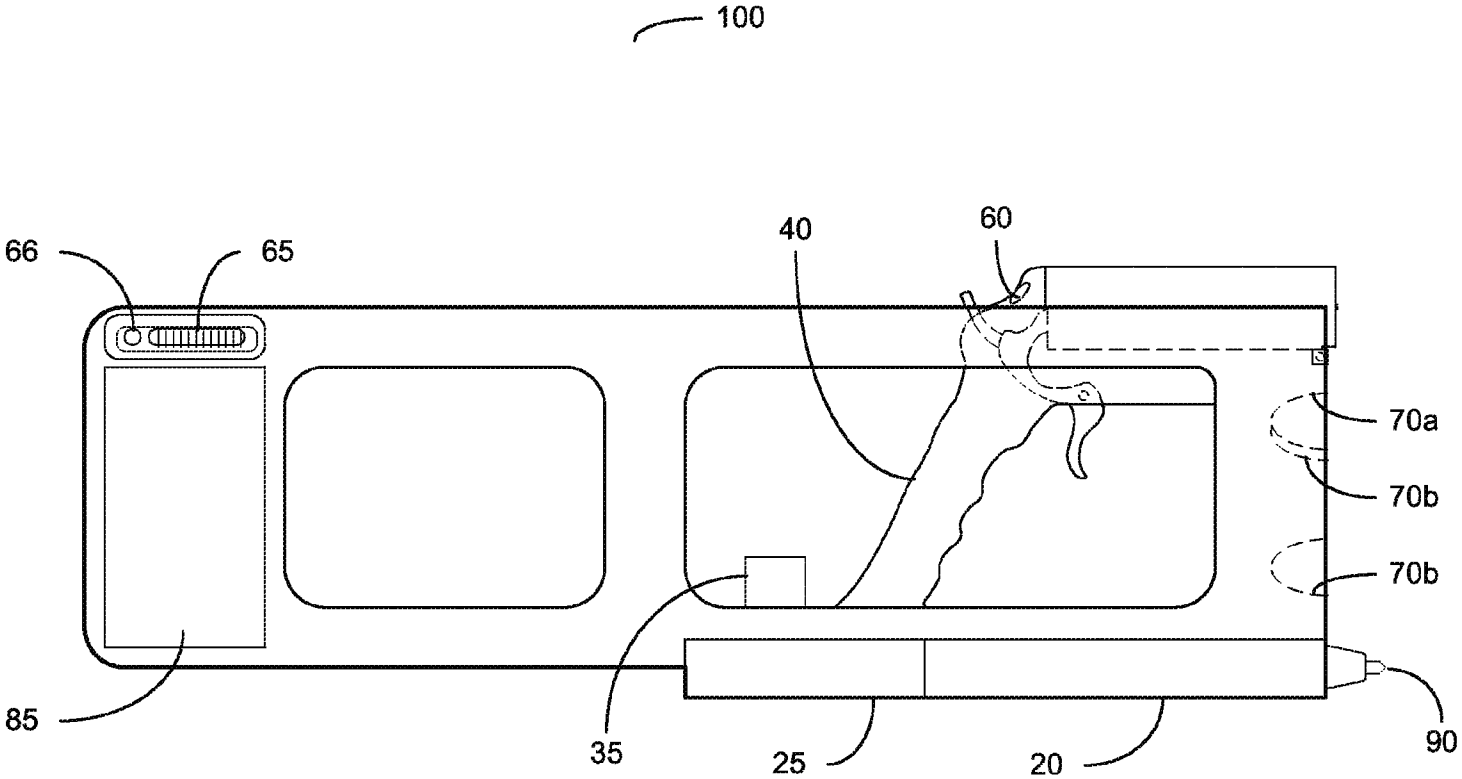
FIG. 4 illustrates a right &de profile view of an exemplary embodiment of an arm enclosure mount for a non-lethal weapon mount system with modular weapons components.

FIG. 4 is a right side profile view of an exemplary embodiment of an arm enclosure mount 100 for a non-lethal weapon mount system with modular weapons components. Ball chamber 25, below ball hopper mount 35, and marker barrel 20 are visible on the right side of non-lethal weapon mount system with modular weapons components 100. Non-lethal projectiles from ball hopper 30 (not shown in FIG. 4) enter ball chamber 25 and are discharged through marker barrel 20 when electronic trigger 60 is pressed.

Electronic trigger 60 is located on the side of hand grip 40. Electronic trigger 60 is independently activated from other switches and triggers, allowing the user to fire non-lethal projectiles at an assailant independently from other non-lethal weapons when that is the appropriate non-lethal weapon to use. Electronic trigger 60, like all triggers for the modular weapons supported by arm enclosure mount 100, can appear on any side of hand grip 40.

Battery compartment 85 houses battery, and is located in the back of non-lethal weapon mount system with modular weapons components 100 for weight balance. Battery powers LEDs 71*a*, 71*b* and 71*c*, stunning device 90, and electronic trigger 60 to discharge non-lethal projectiles. Master power switch 65 and confirmation button 66 are located above battery compartment 85 for the purposes of deactivating modular weapons. Confirmation button 66 must be pressed along with master power switch 65 when powering off modular weapons to prevent accidental deactivation of modular weapons components.

Figure 5:
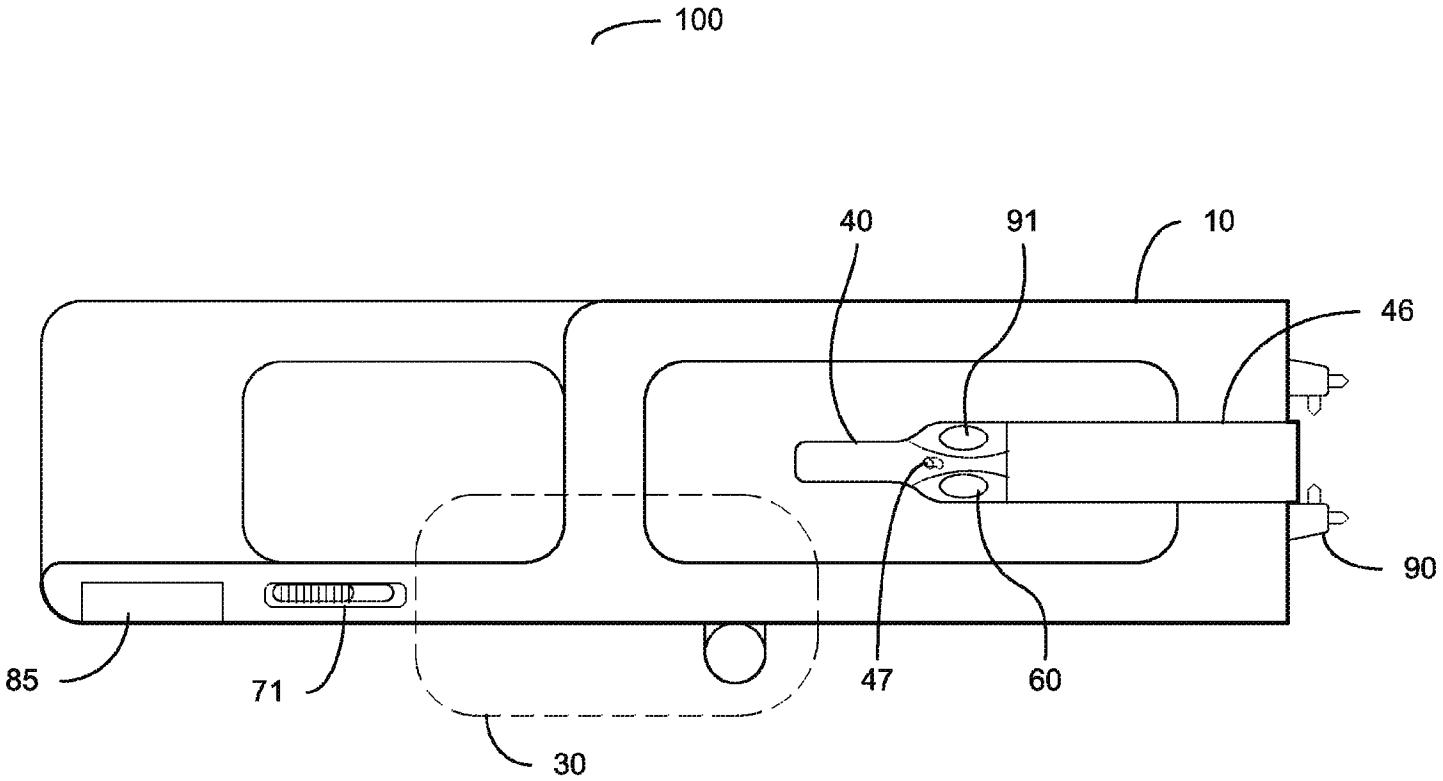
FIG. 5 illustrates a top view of an exemplary embodiment of an arm enclosure mount for a non-lethal weapon mount system with modular weapons components.

FIG. 5 is a top view of an exemplary embodiment of an arm enclosure mount 100 for a non-lethal weapon mount system with modular weapons components. Stunning device 90 protrudes from the front of arm enclosure mount 100. Deterrent spray housing 46 is shown above arm enclosure mount 100. Hand grip 40 contains stunning device switch 91, electronic trigger 60 and deterrent spray safety switch 47. Ball hopper 30 mounts above arm enclosure mount 100. Battery compartment 85 and LED light switch 71 are located at the back of arm enclosure mount 100.

Figure 6:
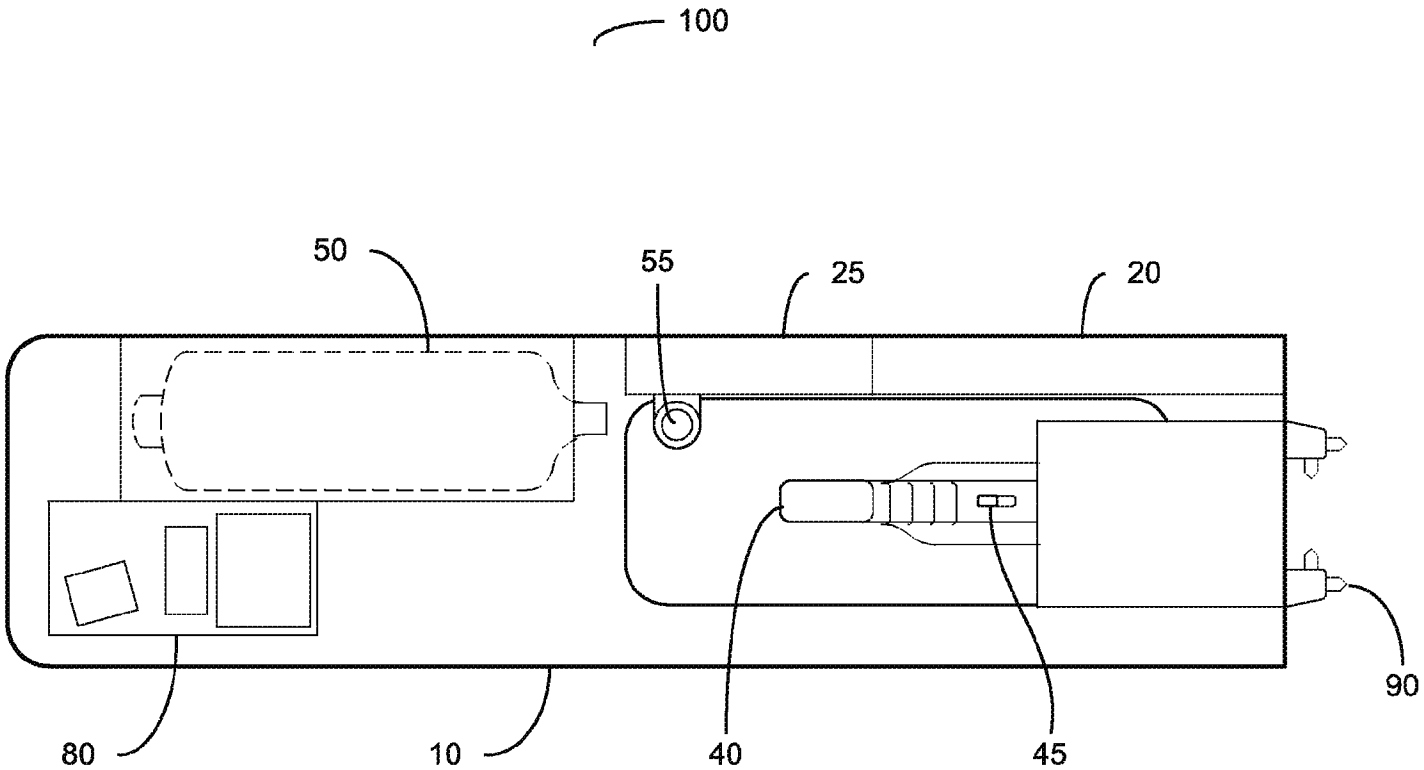
FIG. 6 illustrates a bottom view of an exemplary embodiment of an arm enclosure mount for a non-lethal weapon mount system with modular weapons components.

FIG. 6 is a bottom view of an exemplary embodiment of an arm enclosure mount 100 for a non-lethal weapon mount system with modular weapons components. Stunning device 90 protrudes from the front of arm enclosure mount 100 from stunning device compartment 95 (not shown in FIG. 6). Deterrent spray trigger 45 is located on bottom of hand grip 40. Air tank 50 mounts to the bottom of arm enclosure mount 100 and connects to ball chamber 25 at air intake connection 55. Electronic trigger circuit board 80 controls and times discharge of non-lethal projectiles through marker barrel 20 when electronic trigger 60 (not shown in FIG. 6) is pressed.

Figure 7:
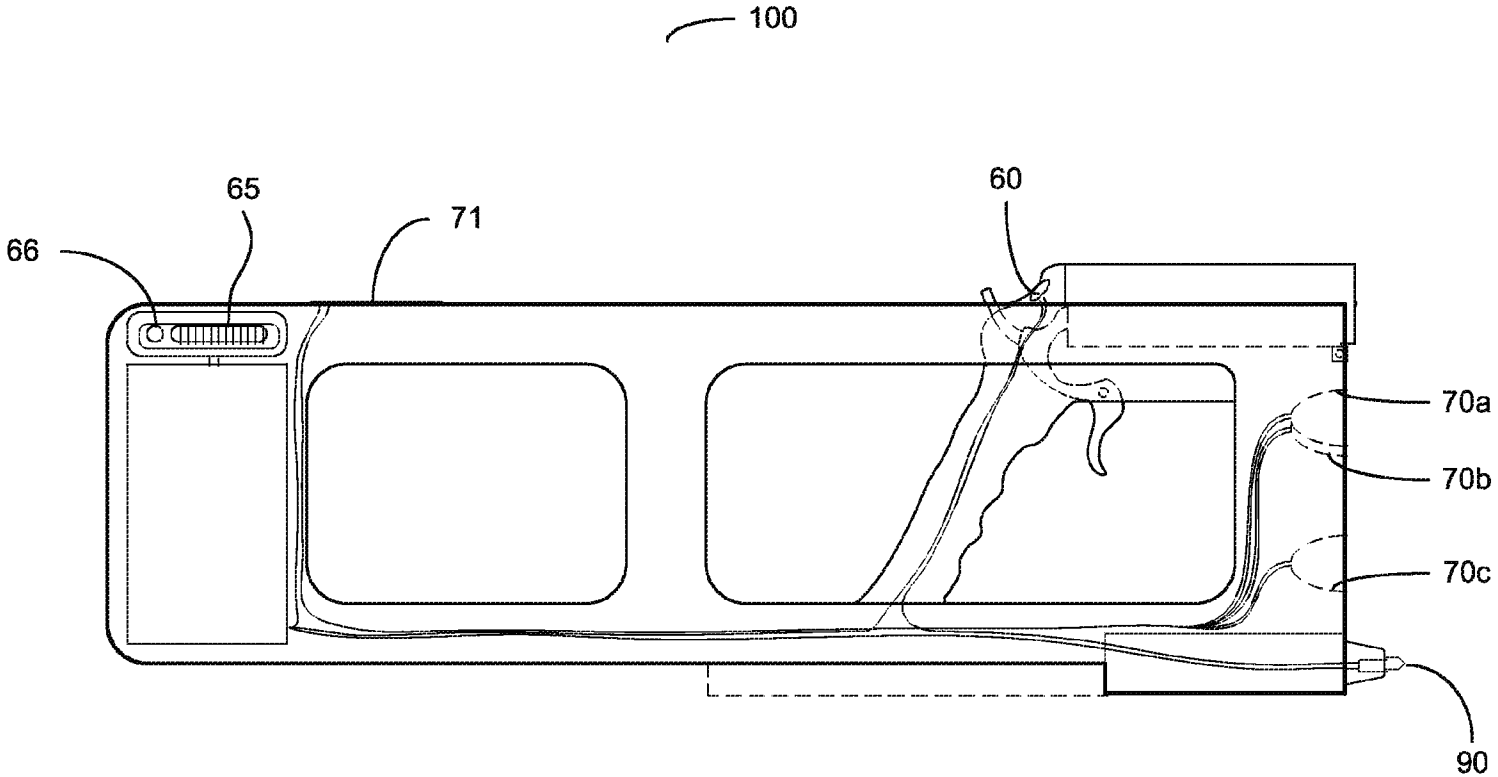
FIG. 7 illustrates the wiring of an exemplary embodiment of an arm enclosure mount for a non-lethal weapon mount system with modular weapons components.

FIG. 7 illustrates the wiring of an exemplary embodiment of a non-lethal weapon mount system with modular weapons components. As illustrated in FIG. 7, LEDs 71*a*, 71*b* and 71*c*, stunning device switch 91, stunning device 90 and electronic trigger 60 are wired to battery. Battery is also wired to LED light switch 72, master power switch 65 and confirmation button 66.

LED light switch 72 is independently activated from other switches and triggers, allowing the user to flash LEDs at an assailant independently of other non-lethal weapons when that is the appropriate non-lethal weapon to use. LED light switch 72 may further allow a user to flash or shine a light at varying lumen levels at a potential assailant, allowing the user to operate LEDs at varying ranges of intensity.

In exemplary embodiments, a non-lethal weapon mount system may incorporate a wireless communication device, such as a GPS unit, radio transmitter/receiver and other devices known in the art.

What is claimed is:

1. A multi-level protection device mounting apparatus comprised of an arm mount enclosure frame having a front section, a rear section, and capable of being secured to a human forearm;

at least one light panel integrally attached to the front section of said arm mount enclosure frame;

at least one side of said arm mount enclosure frame which is elongated to stabilize said arm mount enclosure frame along the outward portion of a human forearm wherein said arm mount enclosure frame includes a plurality of structural surface attachment components attached to said arm mount enclosure frame including:

at least one hand grip attached to said arm mount enclosure frame;

at least one control handle, to which at least one weapon control switch is affixed, said control handle being attached to said arm mount enclosure frame;

at least one modularly mounted weapon component attached to said arm mount enclosure frame; and at least one power source attached to said arm mount enclosure frame.

2. The apparatus of claim 1 wherein one said structural surface attachment components is deterrent spray receptacle support bar.

3. The apparatus of claim 2 wherein said support bar further includes a contour adapted to receive a deterrent spray receptacle.

4. The apparatus of claim 1 wherein one of said structural surface attachment components is a mechanical support assembly to support a projectile launching weapon.

5. The apparatus of claim 4 wherein said mechanical support assembly is attached to said arm mount enclosure frame by components selected from a group including brackets, screws, bolts, screws, braces, adhesives, interlocking components, complementary contoured components, threaded components and combinations thereof.

6. The apparatus of claim 1 wherein one of said structural surface attachment components is a plurality of frame components forming a securing aperture to support a stunning device operatively coupled to said power source.

7. The apparatus of claim 1 wherein one of said structural surface attachment components is frame contour adapted to support a hand grip.

8. The apparatus of claim 1 wherein said frontward light panel further includes a plurality light mounting recesses and lights operatively coupled to said power source.

9. The apparatus of claim 1 which further includes at least one weapon control switch that is affixed to said hand grip.

10. The apparatus of claim 1 which further includes at least one trigger that is affixed to said hand grip which controls at least one modular weapon component.

11. The apparatus of claim 10 wherein at least one weapon control switch affixed to said hand grip independently activates a single weapon.

12. The apparatus of claim 1 which further includes a predetermined combination of weapons operatively coupled to said frame.

13. The apparatus of claim 1 which further at least one modularly mounted weapon component selected from the group consisting of a deterrent spray, pepper spray, non-lethal projectile, flashlight, spotlight, flashing light, alert light, audible alarm, electroshock device, stunning device, stun spray, club, sharp protrusion, electrified protrusion, and combinations thereof.

14. The apparatus of claim 1 which further includes a master power switch which can deactivate said at least one modularly mounted weapon component.

15. The apparatus of claim 14 which further includes a confirmation button for said master power switch which must be pressed when powering off non-lethal weapon mount system with modular weapons components in order to prevent accidental powering off while said non-lethal weapon mount system with modular weapons components is in use.

16. The apparatus of claim 1 wherein said arm mount enclosure frame further includes an arm support platform.

17. The apparatus of claim 1 wherein said arm mount enclosure frame further includes an arm support appendage.

18. The apparatus of claim 1 wherein said mount enclosure frame further includes at least one tubular housing component.

19. The apparatus of claim 1 wherein said arm mount enclosure frame is integrally constructed.

20. The apparatus of claim 1 which further includes at least one wireless communication device.

* * * * *